US005619876A

United States Patent [19]

Choi

[11] Patent Number: 5,619,876

[45] Date of Patent: Apr. 15, 1997

[54] METHOD FOR FLATTENING PARTIALLY DEPRESSED METAL BODY OF AUTOMOBILE

[75] Inventor: Yoonho Choi, 27-3, Pyolyang-dong, Kwachon-si, Kyongki-do, Rep. of Korea

[73] Assignees: Yoonho Choi; Wounho Choi, both of Kyongki-do, Rep. of Korea

[21] Appl. No.: 384,330

[22] Filed: Feb. 1, 1995

[30] Foreign Application Priority Data

Feb. 7, 1994 [KR] Rep. of Korea ..... 94-2225

[51] Int. Cl.[6] ..... B21D 1/12

[52] U.S. Cl. ..... 72/37; 72/705

[58] Field of Search ..... 72/479, 705, 37

[56] References Cited

U.S. PATENT DOCUMENTS 2,844,060 7/1958 Hagerty et al. ..... 72/479

2,852,971 9/1958 Macaluso, Jr. ..... 72/705

OTHER PUBLICATIONS

Taking Profits Out of Bumps, Trimo–Ferguson Manual, Trimont Mfg. Co., Boston, Mass., 1930, pp. 1–3.

*Primary Examiner*—Lowell A. Larson

*Attorney, Agent, or Firm*—Whitham, Curtis, Whitham & McGinn

[57] ABSTRACT

A method for flattening a partially depressed metal body of an automobile is disclosed. The method rapidly and nearly completely flattens, using a simple instrument, the depressed body such that the existing paint of the body does not peel irrespective of the flattening work. A fluorescent lamp is placed such that the lamp is horizontal placed relative to a depressed metal plate of the body and opposed to a flattening worker. A flattening instrument is placed under the depressed metal plate such that the tip of the instrument is precisely placed under the center of a depressed part of the metal plate. The handle of the instrument is repeatedly, rapidly, slightly and elastically pushed down until the depressed part is repeatedly levered up and completely flattened by repeated leverage of the instrument about a point of action.

13 Claims, 2 Drawing Sheets

METHOD FOR FLATTENING PARTIALLY DEPRESSED METAL BODY OF AUTOMOBILE

BACKGROUND OF THE INVENTION

1. Field of the Invention

The present invention relates in general to a method for flattening a partially depressed metal body, the body including doors, a hood and a trunk lid, of an automobile and, more particularly, to an improvement in such a body flattening method for rapidly and nearly completely flattening the partially slightly depressed body with the paint free from damage such that the existing paint of the body does not peel irrespective of the flattening work.

2. Description of the Prior Art

In the prior art, a partially depressed metal body of an automobile has been flattened and repaired through a plate work, a repainting work, a heat treatment and the like. However, the above flattening method is shown to have a problem that the method is accompanied by waste of considerable cost and time and fails in completely flattening the partially depressed body. Furthermore, the above method remains a slight difference of color between the existing painted portion and the partially repainted portion of the metal body after flattening the partially depressed body.

That is, in the typical plate work for flattening the partially depressed metal body of the automobile, the depressed part of the metal body is hammered outward at the inside of the depressed part after removing parts from the inner wall of the body about the depressed part so that the depressed part is flattened. The hammering for flattening the depressed part of the metal body inevitably causes the paint on the outer wall of the body to peel from the wall due to hammering impact. Therefore, the outer wall of the hammered part of the metal body should be additionally subjected to the repainting work so that the above method causes waste of considerable cost and time and forms a slight difference of color between the existing painted portion and the partially repainted portion of the metal body after flattening the partially depressed body. The above method also fails in completely flattening the partially depressed body.

When flattening a partially slightly depressed body with the paint free from damage through the above flattening method, the flattening wastes cost and time as much as used in flattening a heavily depressed body. Due to such waste of cost and time, the partially slightly depressed body may be often neglected irrespective of bad appearance of the depressed body.

SUMMARY OF THE INVENTION

It is, therefore, an object of the present invention to provide a method for flattening a partially depressed metal body of an automobile in which the above problems can be overcome and which rapidly and nearly completely flattens, using a simple instrument and separating no part from the body, the depressed body such that the existing paint of the body does not peel irrespective of the flattening work.

In order to accomplish the above object, a method for flattening a partially depressed metal body of an automobile in accordance with a preferred embodiment of the present invention comprising the steps of: placing a fluorescent lamp about the depressed metal body such that the lamp is horizontal placed relative to a depressed metal plate of the body and opposed to a flattening worker; placing a flattening instrument having a sharpened and bent tip and a handle at both ends thereof under the depressed metal plate such that the tip is placed under a depressed part of the metal plate; precisely placing the tip of the instrument under the center of the depressed part of the metal plate using difference between light and shade of a reflection reflected on the metal plate about the depressed part by light of the lamp; and repeatedly, rapidly, slightly and elastically pushing down the handle of the instrument with a point of action until the depressed part is repeatedly levered up and completely flattened by repeated leverage of the instrument about the point of action.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
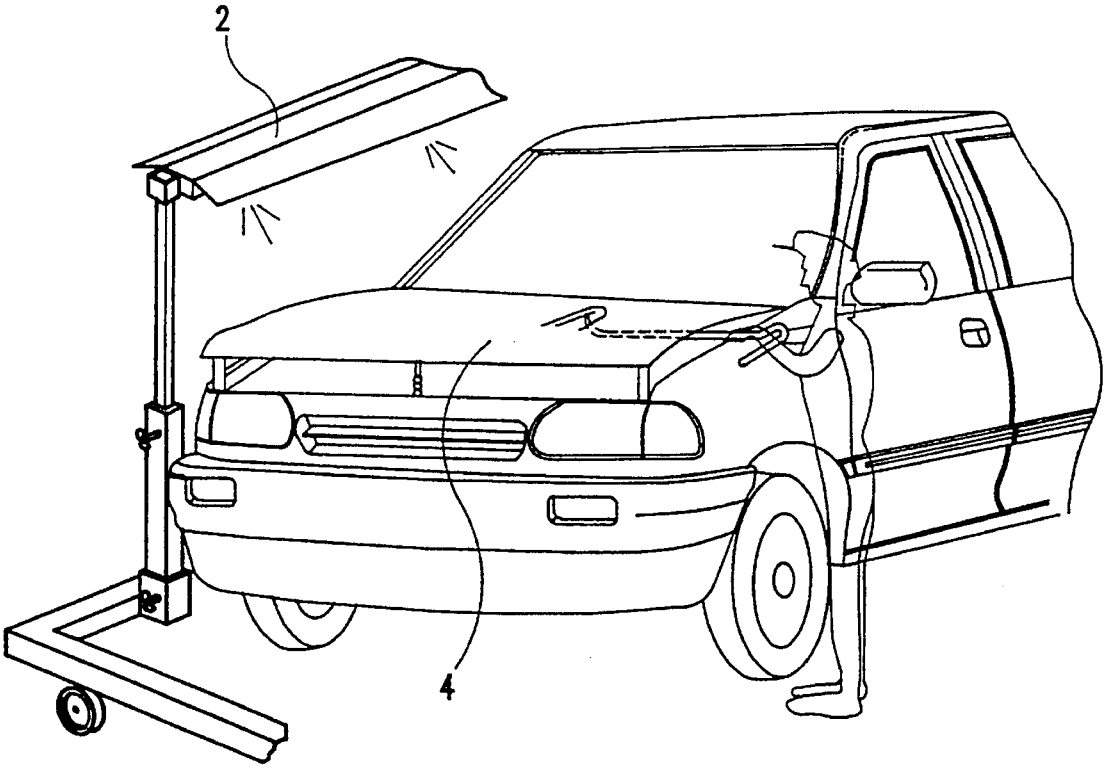
FIG. 1 is a perspective view showing the positional relation between a fluorescent lamp, an automobile body and a worker when flattening a depressed part of the body through a flattening method of the invention in a poorly lighted room.

With reference to FIG. 1, there is shown a positional relation between a fluorescent lamp, a partially depressed metal body of an automobile and a worker when flattening a depressed metal plate of the body through a flattening method of the invention in a poorly lighted room. As shown in the drawing, the work for flattening the depressed body through the method of the invention in the poorly lighted room is carried out under the condition that the fluorescent lamp 2 including a pair of parallel fluorescent tubes is placed about the automobile body. That is, the lamp 2 is placed about the automobile body such that the lamp 2 is horizontal placed relative to the partially depressed metal plate 4 of the body. In this case, one of the fluorescent tubes of the lamp 2 is turned on while the other tube is turned off. Additionally, the worker stands near the automobile body such that the worker is opposed to the horizontally placed lamp 2.

The flattening work with the horizontally placed lamp 2 shown in FIG. 1 is particularly for flattening a depressed part of a horizontal metal plate, for example, a hood, of the body. However when flattening a depressed part of a vertical metal plate, for example, a door or a side panel, of the automobile body, the lamp 2 will be vertically placed differently from the position of FIG. 1. In this case, the worker stands near the automobile body such that the worker is opposed to the vertically placed lamp 2. That is, when flattening the depressed part of a door through the method of this invention, the fluorescent lamp 2 is vertically placed in the front of the side of the door while the worker stands in the back of the side of the door such that the worker is opposed to the vertically placed lamp 2.

Figure 2:
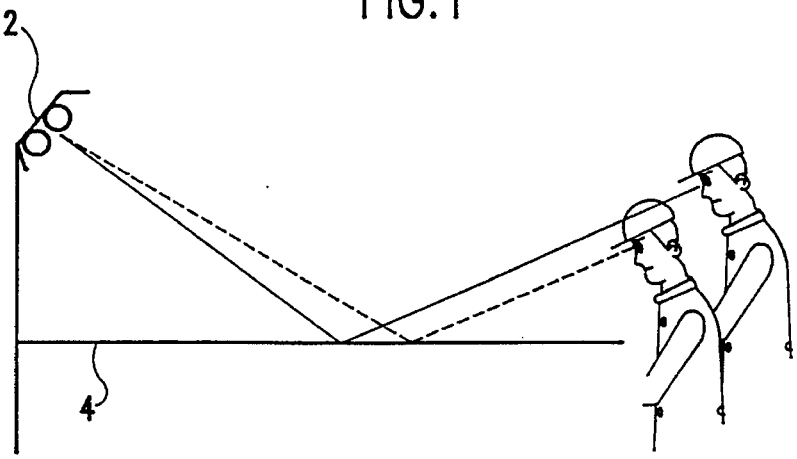
FIG. 2 is a schematic view showing movement of reflection reflected on the partially depressed metal plate of the automobile body by light of the fluorescent lamp in accordance with movement of worker's eyes.

When flattening the depressed part of the hood through the method of this invention, the worker primarily adjusts the level of vision by lifting or lowering his eyes such that the reflection reflected on the partially depressed metal plate 4 by light of the lamp 2 is precisely formed on the depressed part of the plate 4. Therefore, the worker will easily trace the center of the depressed part of the plate 4. In this case, when the worker lifts the level of vision as shown at the solid line of FIG. 2 or moves his head close to the lamp 2, the reflection reflected on the depressed metal plate 4 by the lamp 2 moves toward the lamp 2. On the contrary, when the worker lowers the level of vision as shown at the dotted line of FIG. 2 or moves his head away from the lamp 2, the reflection reflected on the depressed metal plate 4 by the lamp 2 moves toward the worker.

When the reflection reflected on the depressed metal plate 4 by the lamp 2 is located on the depressed part of the metal plate 4, the reflection will be distorted due to the depressed configuration of the part so that it is possible to easily and reliably trace the depressed part even when the part is minutely depressed such that the depressed part is scarcely traced in another method. Additionally, as the reflection reflected on the depressed metal plate 4 by the turned-on tube of the lamp 2 is bright while the reflection reflected on the depressed metal plate 4 by the turned-off tube of the lamp 2 is faint, the worker can precisely trace the center of the depressed part of the plate 4 by adjusting the level of vision and letting the bright reflection and the faint reflection of the lamp 2 be alternately formed on the depressed part of the plate 4.

Figure 3:
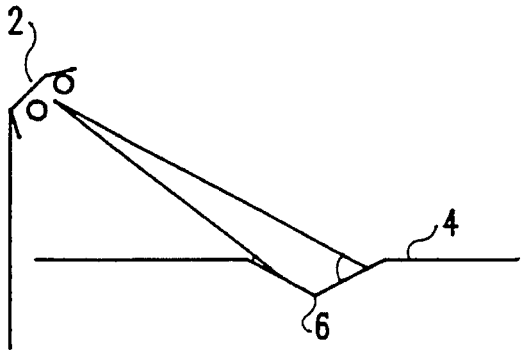
FIG. 3 is a schematic view showing a difference between light and shade of the reflection reflected on the depressed part of the body by the light of the lamp.

When the reflection of the lamp 2 is precisely formed on the depressed part of the metal plate 4, the reflection will be distorted due to the depressed configuration of the part. In this case, brightness of the reflection will vary. The incident angle of the light of the lamp 2 at the center 6 of the depressed part is relatively acute, otherwise stated, the center 6 of the depressed part receives the light of the lamp 2 at an acute angle as shown in FIG. 3. The incident light of the lamp 2 thus forms the relatively faint reflection on the center 6 of the depressed part. However, the incident angle of the light of the lamp 2 at the section between the center 6 of the depressed part and the edge of the depressed part close to the worker is relatively obtuse such that the incident angle at that section approaches a right angle. Therefore, the incident light of the lamp 2 forms the relatively bright reflection on that section of the depressed part.

Figure 4:
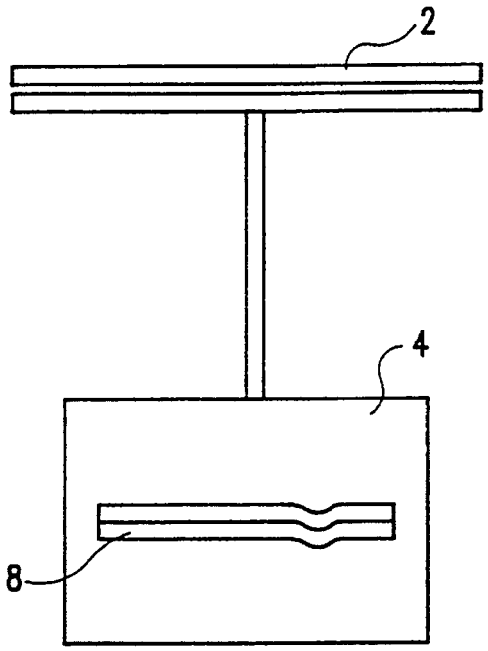
FIG. 4 is a schematic view particularly showing a configuration of the reflection reflected on the depressed part of the body by the light of the lamp, which reflection is observed at the position of the worker.

Therefore, the center 6 or the deepest point of the depressed part of the metal plate 4 is easily traced due to the distorted configuration of the reflection 8 formed on the depressed metal plate 4 by the light of the lamp 2 and due to the difference of brightness of the distorted reflection 8. That is, the center of the depressed part of the plate 4 in the left and right direction of the worker is the longitudinal center of the distorted part of the reflection 8 formed by the lamp 2 as shown in FIG. 4. However, the center of the depressed part in the front and rear direction of the worker is the interfacial line of the distorted part of the reflection 8.

Of course, the center 6 of the depressed part of the plate 4 may be often traced with the naked eye. However, when tracing the center 6 of the depressed part using the light of the lamp 2 as described above, it is possible to precisely trace a minutely depressed part of the plate 4 and to relatively precisely trace the center 6 of the depressed part even when the metal plate 4 is depressed such that the center 6 of the depressed part is indistinct or the center 6 is shown to be scarcely traced. This is because that a surface which is flat at first sight is shown to be practically uneven when viewing, using light, the surface tilted to one side.

Figure 5:
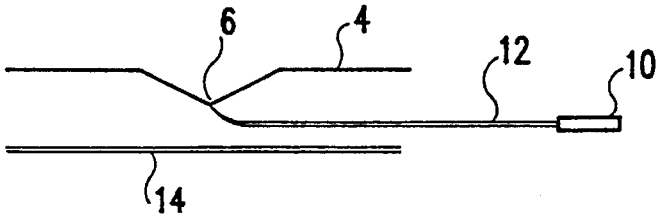
FIG. 5 is a schematic view particularly showing a flattening work using an instrument of the invention placed under the depressed metal plate of the body and leaning on a structure of the body.

After tracing the center 6 of the depressed part of the metal plate 4, a depressed part flattening instrument 12. having a sharpened, bent tip as well as a handle 10 is placed under the depressed metal plate 4 as shown in FIG. 5. The method of this invention selectively uses varieties of instruments 12 which are different in their lengths, thicknesses, bending angles of the bent tips, bending shapes of the tips and lengths of the tips. The varieties of instruments 12 of different sizes and configurations are appropriately selectively used in accordance with position, depth and size of the depressed part of the plate 4.

In most cases, there is a space or a hole, suitable for inserting the instrument, between the metal plate 4 of the automobile body and a structure 14 mounted on the inner wall of the plate 4 so that there will be no problem in inserting and placing the instrument 12 under the depressed metal plate 4 for flattening the depressed part of the plate 4. However, there may be neither space nor hole allowing insertion of the instrument 12 between the plate 4 and the structure 14. In this case, the structure 14 should be removed from the inner wall of the plate 4 or a hole for insertion of the instrument 12 should be formed in the automobile body prior to placing the instrument 12 under the depressed metal plate 4. When forming the hole for insertion of the instrument 12 in the automobile body, it is preferred to form the hole in a part scarcely noticed. The hole will be preferably plugged with an appropriate plug after the flattening work for the depressed plate of the body.

After roughly placing the instrument 12 under the depressed plate 4, the instrument 12 is moved relative to the plate 4 such that the bent tip of the instrument 12 is placed under the depressed part of the plate 4. In this state, the depressed part of the i! plate 4 should be observed with carefulness using the fluorescent light while sophisticatedly moving the tip of the instrument 12 relative to the depressed part of the plate 4 so that the position of the tip of the instrument 12 under the depressed part can be searched by the worker at the top of the metal plate 4. This is because that even the minutest upward thrusting motion of the tip of the instrument 12 for flattening the depressed part is searched at the top of the plate 4 when carefully observing the depressed part of the plate 4 using the fluorescent light during the flattening work as described above.

Figure 6:
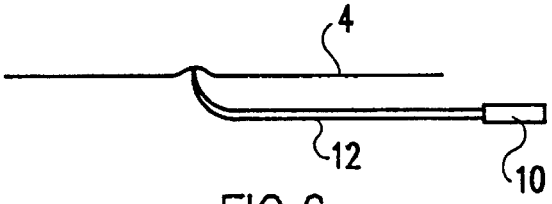
FIG. 6 is a schematic sectional view exaggeratingly showing a slight upward thrusting motion of a tip of the instrument for flattening the partially depressed metal plate.
Figure 7:
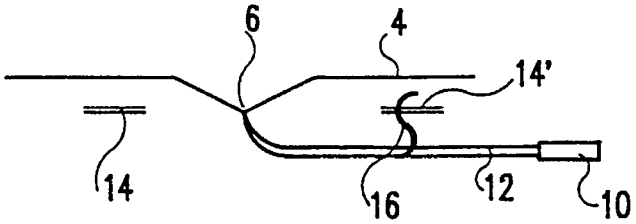
FIG. 7 is a schematic view showing a flattening work using an S-shaped hook as a point of action of leverage of the instrument in accordance with another embodiment

FIG. 6 is a schematic sectional view exaggeratingly showing the slight upward thrusting motion of the tip of the instrument 12 for the metal plate 4. Of course, it should be understood that when slightly thrusting up the metal plate 4 by the tip of the instrument 12 on the inner wall of the plate 4, the upward thrust motion of the plate 4 is minute such that the motion is not noticed by naked eyes. However, there is a delicate thrust motion in the metal plate 4 even though the thrust motion of the plate 4 as a result of upward thrusting motion of the tip of the instrument 12 is minute such that the motion is not noticed by the naked eyes. Therefore, it is possible to search, at the top of the plate 4, the position of the tip of the instrument 12 placed under the plate 4 when carefully observing the delicate difference between light and shade of the reflection 8 reflected on the plate 4 by the fluorescent lamp 2.

The upward thrust motion of the metal plate 4 is minutest such that it merely causes the minutest difference between light and shade of the reflection 8 reflected on the metal plate 4 by the lamp 2. Therefore, when the tip is not moved relative to the plate 4, it will be impossible to search, at the top of the plate 4, the position of the tip of the instrument 12 regardless of use of the difference between light and shade of the reflection 8. However, when the tip of the instrument 12 is moved relative to the plate 4 under the condition that the tip of the instrument 12 comes into slight contact with the inner wall of the plate 4, even the minutest difference between light and shade of the reflection 8 reflected on the outer wall of the plate 4 by the lamp 2 can be observed.

However, it should be understood that the worker does not practically observe the minutest difference between light and shade of the reflection 8 reflected on the outer wall of the plate 4 by the lamp 2 but feels as if he directly saw, at the top of the plate 4, the tip of the instrument 12, which tip is moved relative to the plate 4 while coming into slight contact with the inner wall of the plate 4. The worker needs to be generally trained for two or three days until the worker somewhat observes movement of the tip of the instrument 12 relative to the inner wall of the plate 4. Of course, it will be an easy task for a skilled worker to observe, at the top of the plate 4, movement of the tip of the instrument 12 relative to the inner wall of the plate 4.

After precisely placing the tip of the instrument 12 under the center 6 of the depressed part of the plate 4 as shown in FIG. 6, the depressed part is rapidly repeatedly levered up by leverage of the instrument 12 so that the depressed part will gradually restore its original flatness and the partially depressed metal plate 4 is gradually flattened. At this time, the leverage of the instrument 12 is achieved by repeated downward pushing motions of the handle 10 of the instrument 12. When flattening the depressed part of the plate 4 by repeated leverage of the instrument 12, the depressed part may be not flattened but undesirably somewhat protrude when the depressed part is exceedingly forcibly levered up. In order to prevent the above problem, the handle 10 of the instrument 12 is elastically rapidly pushed down with weak force several times until the depressed part is completely flattened.

When the handle 10 is elastically pushed down under the condition that the tip of the instrument 12 comes into contact with the center 6 of the depressed part of the plate 4, the instrument 12 is elastically turned clockwise about a point of action formed on the structure 14, on which structure 14 the instrument 12 leans against. Therefore, the instrument 12 achieves the leverage for pushing up and flattening the depressed part of the plate 4. Whenever the handle 10 is levered down in order for levering up the depressed part, the depressed part is pushed up to a predetermined extent. However, the downward levering force is removed from the handle 10, the part of the metal plate 4 having been pushed up intends to return to its original depressed state due to its elasticity. Therefore, the upward pushed part somewhat returns to the original depressed state, however, the part fails in completely returning to the original depressed state. That is, the depressed part of the plate 4 is slightly flattened at every leverage of the instrument 12 so that the depressed part is completely flattened so as to return to its flatness at last by repeated leverages of the instrument 12.

When flattening the depressed part of the plate 4 by leverage of the instrument 12 in accordance with the invention, the depressed metal plate 4 needs to be observed using the light of the fluorescent lamp 2 from start to end of the work. This observation for the depressed metal plate 4 using the light of the lamp 2 is not only for prevention of careless protrusion of the plate 4 due to exceeding leverage of the instrument 12 but also for compensatory flattening work for flattening a portion possibly left out of previous flattening work. The compensatory flattening work for the portion possibly left out of previous flattening work is carried out in the same manner as described above.

In order for completely flattening the depressed part of the metal plate 4 and for restoring the original flatness of the depressed metal plate 4 without fail by elastically rapidly pushing down the handle 10 of the instrument 12 with weak force, the worker needs to be somewhat trained in order for having skilled feeling in the hands. About one month training for skilled feeling in the hands is shown to be sufficient regardless of difference of personal ability of workers. Furthermore, even when a portion of the metal plate 4 carelessly protrudes by a unskilled worker during the depressed part flattening work of this invention, the carelessly protruding portion of the plate 4 can restore its flatness by simply slightly hammering or pressing down the carelessly protruding portion while intermittently stopping the main flattening work. Therefore, there will be no problem even when the plate 4 is carelessly pushed up and protrudes during the flattening work of this invention.

There may be no structure 14 suitable for allowing the instrument 12 to lean thereon during leverage of the instrument 12 for levering up and flattening the depressed part of the plate 4. In this case, an S-shaped hook 16 is hung on another structure 14', which structure 14' is mounted on the inner wall of the plate 4 and not suitable for acting as a point of action of leverage of the instrument 12 but suitable for hanging the hook 16 thereon. After hanging the hook 16 on the structure 14', the instrument 12 is hung on the hook 16 so that the instrument 12 can achieve the leverage for levering up and flattening the depressed part of the plate 4 using the hook 16 as the point of action of the leverage of the instrument 12.

When the metal plate 4 is smoothly depressed such that the depressed part of the plate 4 is uniformly circularly depressed centering around a point, the depressed part will be simply flattened and restore its original flatness through the above-described method of this invention. However, the abovedescribed method is shown to fail in simply flattening a linear depressed part or an arcuate depressed part of the plate due to the linear center of the depressed part. However, the linear depressed part or the arcuate depressed part of the plate can be completely flattened when repeating the above flattening work along the center line of the depressed part.

As described above, the present invention provides a method for flattening a partially depressed metal body of an automobile, through which method the partially slightly depressed body with the paint free from damage is rapidly and nearly completely flattened such that the existing paint of the body does not peel irrespective of the flattening work. In the method of this invention, an instrument having a sharpened, bent tip as well as a handle is placed under the depressed metal plate of the body and pushed down at its handle so as to lever up and flatten the depressed metal plate.

The method uses light of a fluorescent lamp having a pair of parallel fluorescent tubes, one of which tubes is turned on while the other tube is turned off so that the lamp forms a reflection on the depressed part of the plate. The reflection is distorted and different in light and shade and this is used in precisely flattening the depressed part.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for flattening a depressed part of a metal body comprising the steps of:

placing a light source including a difference of brightness of relatively light and shade about the depressed metal body such that the configuration is placed generally parallel to a metal plate of the body including said depressed part and opposed to n flattening worker;

placing a flattening instrument having a charpened and bent tip an a handle at ends hereof under the depressed metal plato such that the tip is placed under said depressed part of the metal plate;

precisely placing the tip of the instrument under the center or deepest point of the depressed part of the metal plate by observing difference between light and shade of a reflection including a distortion of reflection of said pattern due to both said depressed part and contact of said tip of said instrument reflected on the metal plate about the depressed part; and repeatedly, rapidly, slightly and elastically pushing the handle of the instrument about a point of action until the depressed part is repeatedly levered up and flattened by repeated leverage of the instrument about the point of action.

2. The method according to claim 1, wherein said point of action of the leverage of the instrument is formed by an S-shaped hook hung to the inner wall of the depressed metal plate, said S-shaped hook in turn supporting the instrument thereon.

3. The method according to claim 2, wherein said center of said depressed part is searched by observing distortion of the reflection as well as by observing difference of light and shade or the reflection.

4. The method according to claim 2, wherein the flattening of the depressed part is checked by observing distortion of the reflection as well as by observing the difference or light and shade of the reflection.

5. A method as recited in claim 2, wherein said S-shaped hook is supported by said body panel.

6. A method as recited in claim 2, wherein said S-shaped hook is supported by structure other than said body panel.

7. The method according to claim 1, wherein said center of said depressed part is searched by observing distortion of the reflection as well as by observing the difference of light and shade of the reflection.

8. The method according to claim 1, wherein the flattening of the depressed part is checked by observing distortion of the reflection as well as by observing the difference of light and shade of the reflection.

9. A method as recited in claim 1, including the further step of repeating said steps of placing and pushing said instrument at a plurality of locations along a linear depressed portion of said plate.

10. A method as recited in claim 1, wherein said reflection of a light source is a reflection of a fluorescent tube.

11. A method as recited in claim 1, wherein said reflection of a relatively light region is a reflection of a pair of fluorescent tubes.

12. A method as recited in claim 1, wherein said reflection of a relatively shade region is a reflection of an interfacial line between two fluorescent tubes.

13. A method as recited in claim 11, wherein one of said pair of fluorescent tubes is energized and another of said pair of fluorescent tubes is not energized.

* * * * *